United States Patent [19]

Bruning

[11] Patent Number: 4,640,247

[45] Date of Patent: Feb. 3, 1987

[54] AIR-FUEL RATIO CONTROL SYSTEM HAVING A FLUID-POWERED BROKEN-LINK MECHANISM

[75] Inventor: E. Eugene Bruning, Normal, Ill.

[73] Assignee: Caterpillar Inc., Peoria, Ill.

[21] Appl. No.: 750,836

[22] Filed: Jul. 1, 1985

Related U.S. Application Data

[63] Continuation-in-part of Ser. No. 698,205, Feb. 4, 1985, abandoned.

[51] Int. Cl.[4] ..... F02D 1/06

[52] U.S. Cl. ..... 123/388; 123/366; 123/383; 123/386

[58] Field of Search ..... 123/383, 386, 387, 388, 123/385, 382, 366, 367, 372

[56] References Cited

U.S. PATENT DOCUMENTS

| | | | |
|---|---|---|---|
| 3,272,295 | 9/1966 | Clements | 192/67 |
| 3,577,967 | 5/1971 | Staudt | 123/386 |
| 3,707,144 | 12/1972 | Galis et al. | 123/179 L |
| 3,742,925 | 7/1973 | Gordon, Jr. et al. | 123/383 |
| 3,777,730 | 12/1973 | Gates et al. | 123/366 |
| 3,795,233 | 3/1974 | Crews et al. | 123/383 |
| 4,120,275 | 10/1978 | Isobe et al. | 123/386 |
| 4,149,507 | 4/1979 | Little, Jr. et al. | 123/383 |
| 4,343,276 | 8/1982 | Jaliwala et al. | 123/383 |

FOREIGN PATENT DOCUMENTS

| | | |
|---|---|---|
| 3246869 | 7/1983 | Fed. Rep. of Germany . |
| 2052094 | 1/1981 | United Kingdom . |

OTHER PUBLICATIONS

Service Manual for 3406B Diesel Truck Engine, Pub. No. SEBR0544, pp. 2-1 to 2-12, by: Caterpillar Tractor Co., published: Oct. 1984.

*Primary Examiner*—Andrew M. Dolinar
*Attorney, Agent, or Firm*—Anthony N. Woloch

[57] ABSTRACT

The subject air-fuel ratio control system for an engine includes a fluid-powered broken-link mechanism which is operatively linked between an air-fuel ratio control device and a fuel quantity control member, such as a fuel injection pump rack. During startup of the engine, the mechanism disables the device to permit excess fuel delivery. The device is automatically activated after engine startup by the mechanism solely in combined response to the existence of engine oil pressure and a governor moving the fuel quantity control member from an excess fuel delivery position to a predetermined position referred to as an air-fuel ratio control setting. This construction minimizes the duration and quantity of any smoke produced during engine startup, simplifies the cost and construction of the air-fuel ratio control device, and permits relatively easy adjustment of the air-fuel ratio control setting.

28 Claims, 10 Drawing Figures

10
14
18
22
26
30
34
38
42
46
50
58
82
86
90
122
150
202
206
210
214
216
218
222
226
230
234
238
242
246
250
254
258
262
266
268
270
274
278
282
286
290
294
298
302
306
310
318
322
326
330
334
338
342
II
IV

AIR-FUEL RATIO CONTROL SYSTEM HAVING A FLUID-POWERED BROKEN-LINK MECHANISM

DESCRIPTION

This is a continuation-in-part of application Ser. No. 698,205 filed Feb. 4, 1985, abandoned.

TECHNICAL FIELD

This invention relates generally to an air-fuel ratio control system for overriding a governor-controlled fuel quantity control member to selectively limit the amount of fuel delivered to an internal combustion engine during each combustion cycle and, more particularly, to an improved air-fuel ratio control system having a broken-link mechanism for automatically disengaging an air-fuel ratio control device from the fuel quantity control member to permit excess fuel delivery for starting the engine and for automatically engaging the air-fuel ratio control device once the engine has started.

BACKGROUND ART

Supercharged internal combustion engines, and, in particular, fuel-injected engines having exhaust-driven superchargers can produce heavy and objectionable exhaust smoke and other noxious emissions when the engine is accelerated rapidly. This can occur if the operator is able to move the engine's fuel quantity control member, such as a fuel injection pump rack, in the fuel-increasing direction faster than the time it takes for the supercharger to build up enough rotational speed to provide sufficient air for combustion of all the additional fuel being delivered. This results in the temporary expulsion of large quantities of unburned fuel as exhaust smoke.

Moreover, fuel-injected engines equipped with exhaust-driven superchargers can create much smoke under a lugging condition. A lugging condition is encountered when the resistance or load on the engine is increased to the extent that the engine rotational speed is reduced below that which is indicated by the governor throttle setting. In a lugging condition, the engine's speed-sensitive governor attempts to regain the engine rotational speed indicated by the governor throttle setting by automatically advancing the fuel quantity control member to supply more fuel. Again, incomplete combustion of the additional fuel may momentarily occur due to an insufficient amount of air being supplied by the supercharger which is initially slowed down during the lugging condition.

Air-fuel ratio control devices are known for automatically preventing an increase in fuel supply during engine operation when the boost or air intake manifold pressure is too low to provide enough air to support complete combustion of that increased fuel supply. For example, in U.S. Pat. No. 4,149,507 issued to Little, Jr. et al on Apr. 17, 1979, such devices may include an integral servo piston and valve unit which during engine operation is hydraulically placed in a restraining relationship with the fuel quantity control member. In order to facilitate dependable starting of the engine, such an integral servo piston and valve unit is adapted to be inoperative during engine shutdown to restrain the fuel quantity control member so that the unrestrained fuel quantity control member can be moved to an excess or maximum fuel delivery position. The unit remains inoperative until such time as a predetermined air intake manifold pressure is attained in response to which the integral servo piston and valve unit moves to a position which permits metering of engine lubrication oil therethrough and activation of the air-fuel ratio control device.

A number of problems are encountered with the above air-fuel ratio control device. First, the integral servo piston and valve unit makes the air-fuel ratio control device complex and expensive to manufacture. Second, faulty or unstable operation of the air-fuel ratio control device may occur if the finely polished surface of the precision valve therein contains burrs due to faulty manufacture or if the precision valve encounters dirt or other abrasive debris in the circulated engine lubrication oil. Third, it is undesirable that the above air-fuel ratio control device depends upon air intake manifold pressure for activation following engine startup since the time lag required for attaining a predetermined air intake manifold pressure unduly prolongs the period in which a smokey engine exhaust is produced.

The present invention is directed to overcoming one or more of the problems as set forth above.

DISCLOSURE OF THE INVENTION

In one aspect of the present invention a fluid-powered broken-link mechanism is disclosed which is adapted to be operatively linked between a governor-controlled fuel quantity control member and an override means for preventing movement of the fuel quantity control member in a fuel-increasing direction when the ratio of air-to-fuel supplied to the operating engine falls below a preselected value. The fluid-powered broken-link mechanism includes a first lever having a shaft portion which is adapted to be rotatively mounted within a housing. A second lever is rotatively mounted on the shaft portion and is also axially movable thereon between a disengaged axial position at which the second lever is completely free of drivable engagement with the first lever and an engaged axial position at which the second lever drivably engages the first lever. An axial biasing means is provided for axially biasing the second lever towards the disengaged axial position and an angular motive means is provided for rotating the first lever relative to the second lever so that the axially engageable portions of the levers are substantially angularly aligned with one another to facilitate drivable engagement. Valve means is provided for selectively blocking and opening fluid communication between a source of pressurized fluid and a fluid power means. The valve means blocks fluid communication to the fluid power means when the first lever is rotated to a first predetermined angular position. The valve means opens fluid communication to the fluid power means to move the second lever under pressurized fluid power to the engaged axial position when the first lever is rotated to a second predetermined angular position.

In another aspect of the present invention, an improved air-fuel ratio control system is provided which includes a movable fuel quantity control member, a governor to control the position of the fuel quantity control member, an override means for selectively overriding the governor to prevent movement of the fuel quantity control member in the fuel-increasing direction when the ratio of air-to-fuel supplied to the engine for combustion falls below a preselected value, and a fluid-powered broken-link mechanism operatively linked between the fuel quantity control member and the override means.

The present invention provides a relatively inexpensive and more reliable mechanism for automatically disengaging an air-fuel ratio control device from a fuel quantity control member to facilitate excess or maximum fuel delivery for dependable starting of an engine and for automatically and quickly engaging the air-fuel ratio control device to perform its control function once the engine starts. This configuration minimizes the duration and amount of smokey exhaust produced during engine startup, simplifies the construction and adjustment of the air-fuel ratio control device, and improves the reliability of the air-fuel ratio control device.

BRIEF DESCRIPTION OF THE DRAWINGS

FIG. 6 is a diagrammatic and partially cross-sectional view taken along line VI—VI of FIG. 4 showing the fluid-powered broken-link mechanism in a normal engine operating position;

FIG. 7 is a view similar to FIGS. 5 and 6 but showing the fluid-powered broken-link mechanism in an engine shutoff position;

BEST MODE FOR CARRYING OUT THE INVENTION

Figures 1, 2:
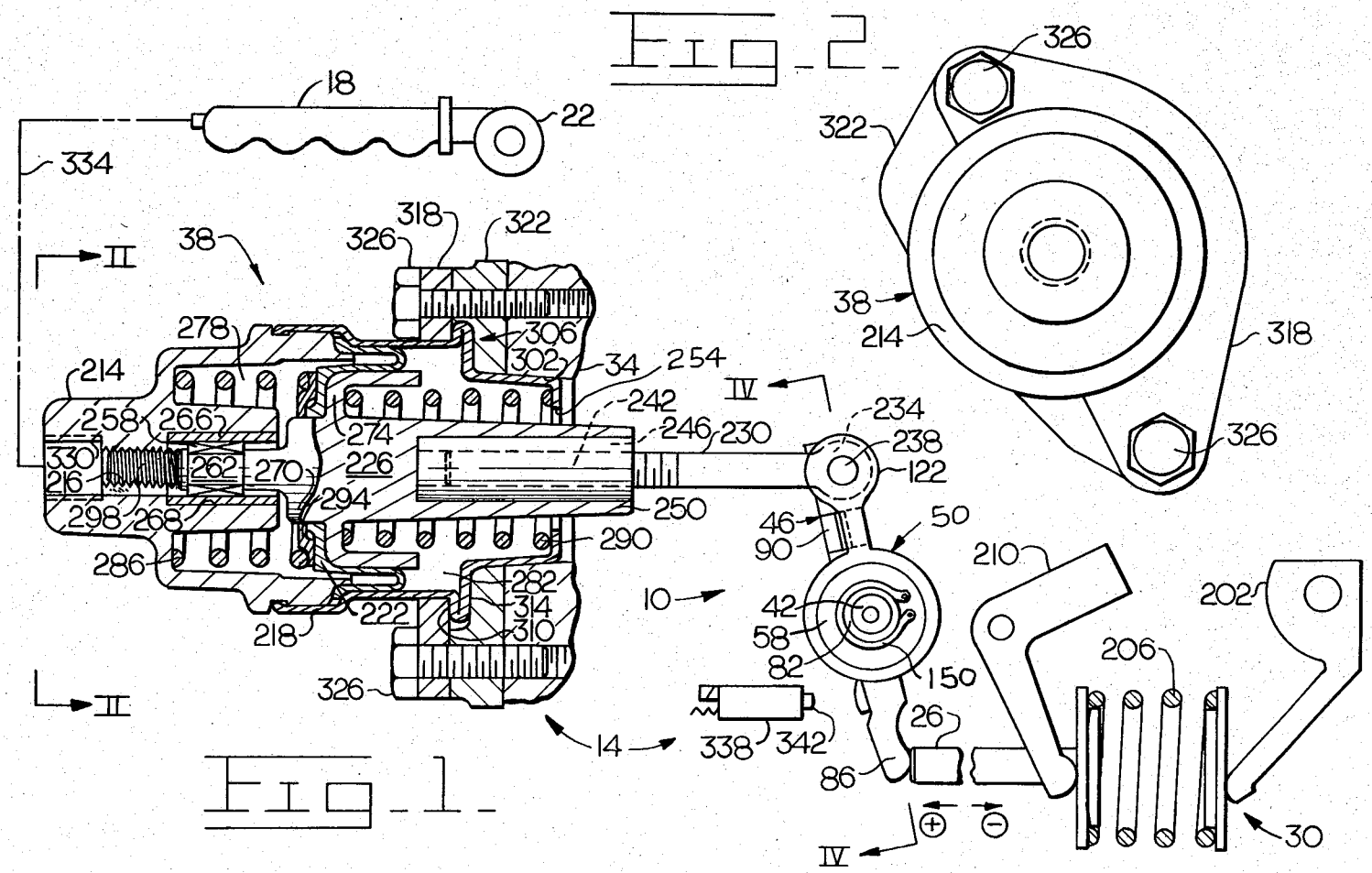
FIG. 1 is a diagrammatic view of a first embodiment of a fluid-powered broken-link mechanism as incorporated in an improved air-fuel ratio control system partially shown in cross section.
FIG. 2 is a diagrammatic partial end view taken along line II—II of FIG. 1.

Referring to FIGS. 1–7 wherein the same reference characters designate the same elements or features throughout all the figures, a first embodiment of a fluid-powered broken-link mechanism 10 is shown for use in an improved air-fuel ratio control system 14 of a supercharged internal combustion engine.

As shown in FIG. 1, the air-fuel ratio control system 14 includes an air intake manifold 18 of the engine (not otherwise shown), an engine exhaust-driven supercharger 22 connected upstream of the manifold to supply the manifold with compressed fresh air, and a fuel quantity control member 26. The fuel quantity control member 26 may, for example, be a conventional fuel injection pump rack or an element connected directly or indirectly to the rack which is axially movable in a fuel-increasing direction (indicated by the adjacent positive arrow) to increase the quantity of fuel supplied to the engine during each combustion cycle and in an opposite fuel-decreasing direction (indicated by the adjacent negative arrow) to decrease the quantity of fuel supplied to the engine during each combustion cycle. The air-fuel ratio control system 14 further includes a governor 30 to control the axial position of the fuel quantity control member 26 in response to an operator's throttle setting and sensed engine speed, a stationary governor housing 34, an override means 38 or air-fuel ratio control device for selectively overriding the governor 30 during engine operation to prevent movement of the fuel quantity control member 26 in the fuel-increasing direction when the ratio of air-to-fuel supplied to the engine for combustion falls below a preselected value, and the fluid-powered broken-link mechanism 10 which is adapted to be operatively linked between the override means 38 and the fuel quantity control member 26.

Figure 3:
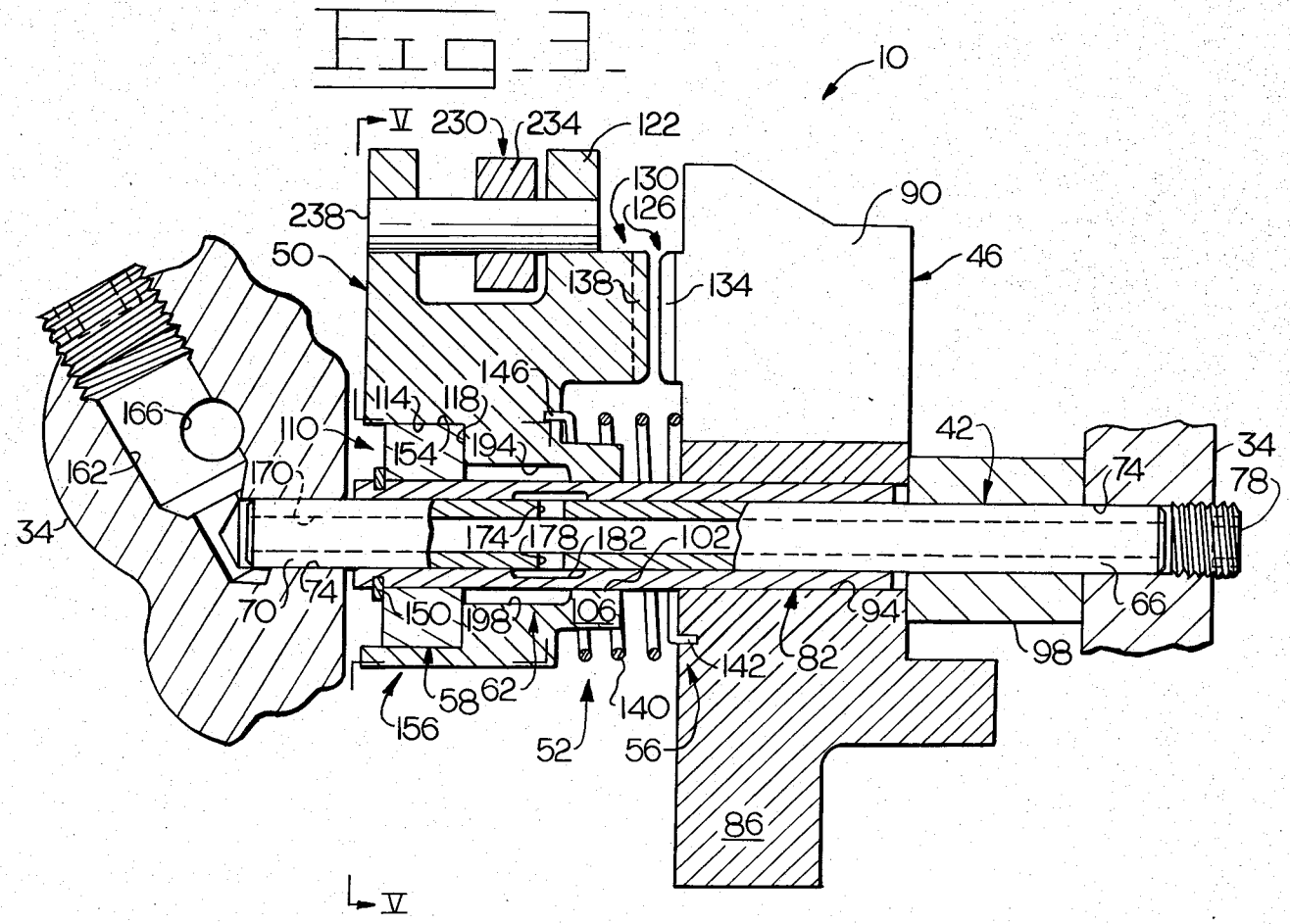
FIG. 3 is a diagrammatic and partially cross-sectional view of the fluid-powered broken-link mechanism of FIG. 1 showing the second lever in the disengaged axial position.
Figure 4:
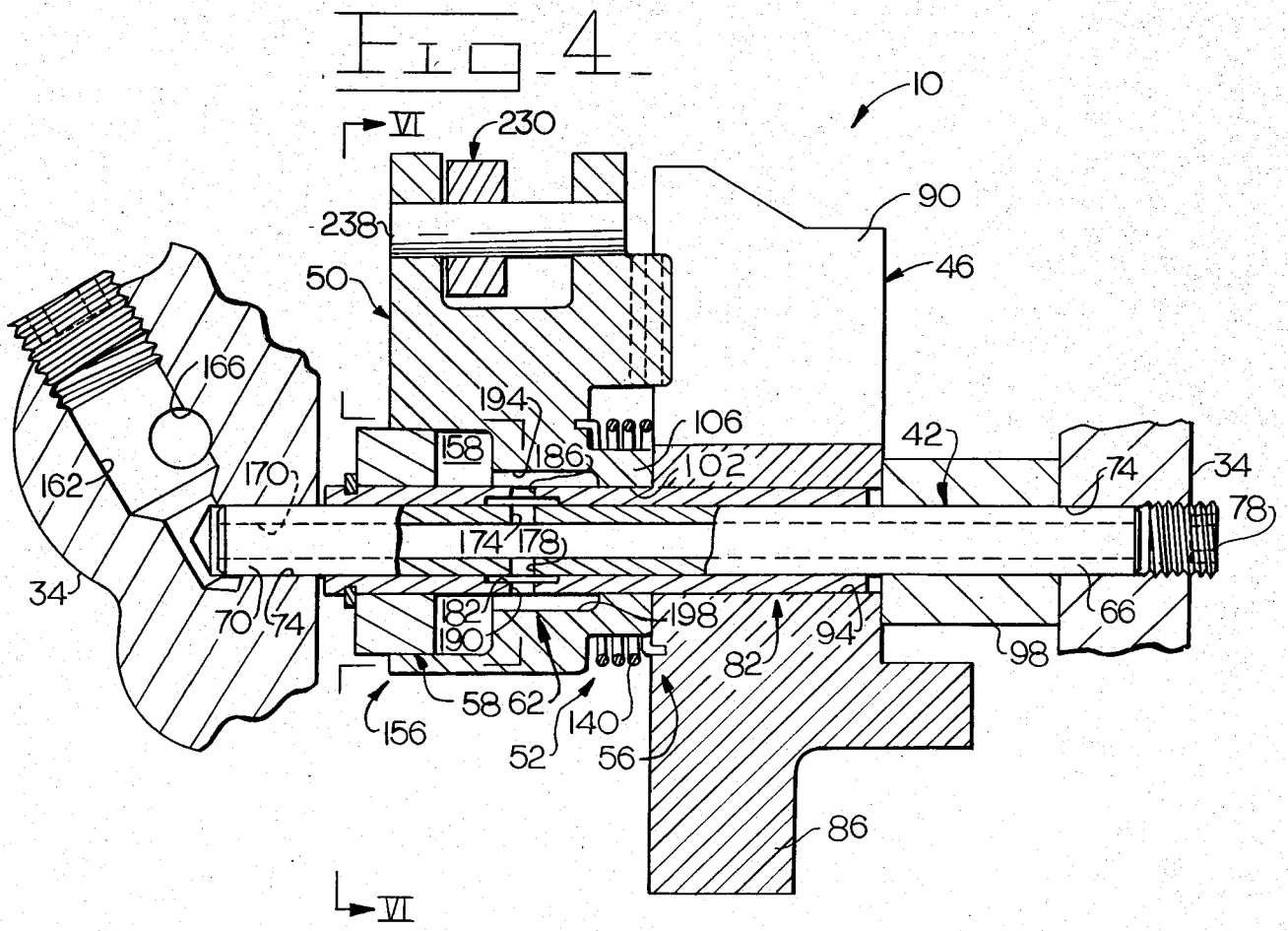
FIG. 4 is a diagrammatic view, similar to FIG. 3 but showing the second lever in the engaged axial position, taken along line IV—IV of FIG. 1.

The fluid-powered broken-link mechanism 10 includes an axle 42, a pair of levers 46,50, an axial biasing means 52, an angular motive means 56, an annular stop 58, and a valve means 62 or a valve device which is cooperatively defined in the axle 42 and the first and second levers 46,50. As shown in FIGS. 3 and 4, the axle 42 has opposite end portions 66,70 which are adapted to be supported or journaled within a cross bore 74 of the governor housing 34. One end portion 66 of the axle 42 is generally restrained from moving axially by a removable plug 78 threadedly secured in the cross bore 74 of the governor housing 34.

As shown in FIGS. 1 and 3–7, the first lever 46 has a laterally extending hollow shaft portion 82 and a pair of relatively fixed arms 86,90 radially extending therefrom wherein one 86 of the arms is adapted to swing into direct contact with the fuel quantity control member 26. The shaft portion 82 is preferably a separate sleeve which is press-fitted or otherwise fixed into a lateral bore 94 of the first lever 46 such that a free end of the shaft portion extends axially from the first lever 46. Alternatively, the shaft portion 82 may be integrally formed on the first lever 46. In either case, the shaft portion 82 is concentrically and rotatively mounted around the relatively longer axle 42 wherein the first lever 46 is spaced from one side of the governor housing 34 by a tubular spacer 98 slidably mounted around the axle 42. Alternatively, the shaft portion 82 may be directly rotatably mounted within the cross bore 74 of the governor housing 34 thereby eliminating the axle 42.

The second lever 50 has a lateral primary bore 102 by which the second lever is concentrically and rotatively mounted around the shaft portion 82 and is also axially movable thereon between a disengaged axial position, shown in FIG. 3 at which the second lever 50 is completely free of drivable engagement with the first lever 46, and an engaged axial position shown in FIG. 4 at which the second lever 50 is drivably and positively engaged in one angular direction (counterclockwise according to FIGS. 1 and 5–7) with the other arm 90 of the first lever 46. As shown in FIG. 3, the second lever further includes a laterally-extending cylindrical portion 106 which surrounds part of the shaft portion 82, a counterbore 110 defined by a cylindrical internal wall 114 and a transverse internal annular shoulder 118 formed at one end of the lateral primary bore 102, and a radially extending bifurcated yoke portion 122. Each of the levers 46,50 includes a laterally-facing and substantially flat tang portion 126,130 having a lateral end surface 134,138 which is complementarily shaped for facilitating initial ramping contact and overlapping relation with another. In the preferred embodiment shown, each lateral end surface 134,138 is beveled at about a 45° angle relative to the plane of the respective tang portion 126,130.

The axial biasing means 52 is provided for axially resiliently biasing the second lever 50 towards the disengaged axial position shown in FIG. 3. The angular motive means 56 is provided for rotating the other arm 90 of the first lever 46 relative to the second lever 50 so that the axially engageable tang portions 126,130 are substantially angularly aligned with one another to facilitate drivable engagement according to FIGS. 1, 4 and 6. As shown in FIG. 3, the axial biasing means 52 and the angular motive means 56 are, in the first embodiment, integrated into a combination helical compression spring 140 and torsion spring mounted generally concentrically around the shaft portion 82 and the cylindrical portion 106 of the second lever 50. This spring is also located axially between the second lever 50 and the arms 86,90 of the first lever 46 except for opposite end portions 142,146 of the spring which are bent axially to angularly contact or torsionally bias the other arm 90 of the first lever 46 relative to the second lever 50.

As shown in FIGS. 1 and 3, the annular stop 58 is slidably and concentrically mounted around the free end portion of the shaft portion 82 by a snap ring 150. The annular stop is positioned radially between the shaft portion 82 and the second lever 50 by fitting within the complementary counterbore 110 of the second lever 50. During axial movement of the second lever 50, the cylindrical internal wall 114 of the second lever 50 is generally guided along a radial peripheral surface 154 of the annular stop although a slight diametral clearance of, for example, about 0.23 millimeters (0.0091 inches) is provided for allowing drainage of pressurized fluid as explained below. The diametral clearance between the shaft portion 82 and the annular stop 58 is preferably somewhat tighter but still constitutes a slip-on fit.

As shown in FIG. 4, the shaft portion 82, annular stop 58, and counterbore 110 of the second lever 50 define a relatively compact fluid power means 156 including an expandable and contractable annular fluid pressure chamber 158 which expands in volume as the second lever 50 slides axially along the shaft portion 82 towards the engaged axial position and which contracts to substantially zero volume as the second lever 50 slides axially along the shaft portion 82 toward the disengaged axial position shown in FIG. 3.

As shown in FIGS. 3 and 4, the valve means 62 is cooperatively defined in the axle 42, the shaft portion 82, and the second lever 50 and is provided for selectively blocking and opening fluid communication between the annular fluid pressure chamber 158 and a source of fluid, preferably engine lubricating oil, which is adapted to be pressurized by an engine-driven oil pump (not shown) only during engine startup and normal engine operation. The engine lubricating oil is communicated to the axle other end portion 70 by a stepped bore 162 and a transversely-intersecting passage 166 which are defined in the governor housing 34 and which are adapted to be in continuous fluid communication with the outlet side of the engine-driven oil pump.

Figures 1, 4, 5:
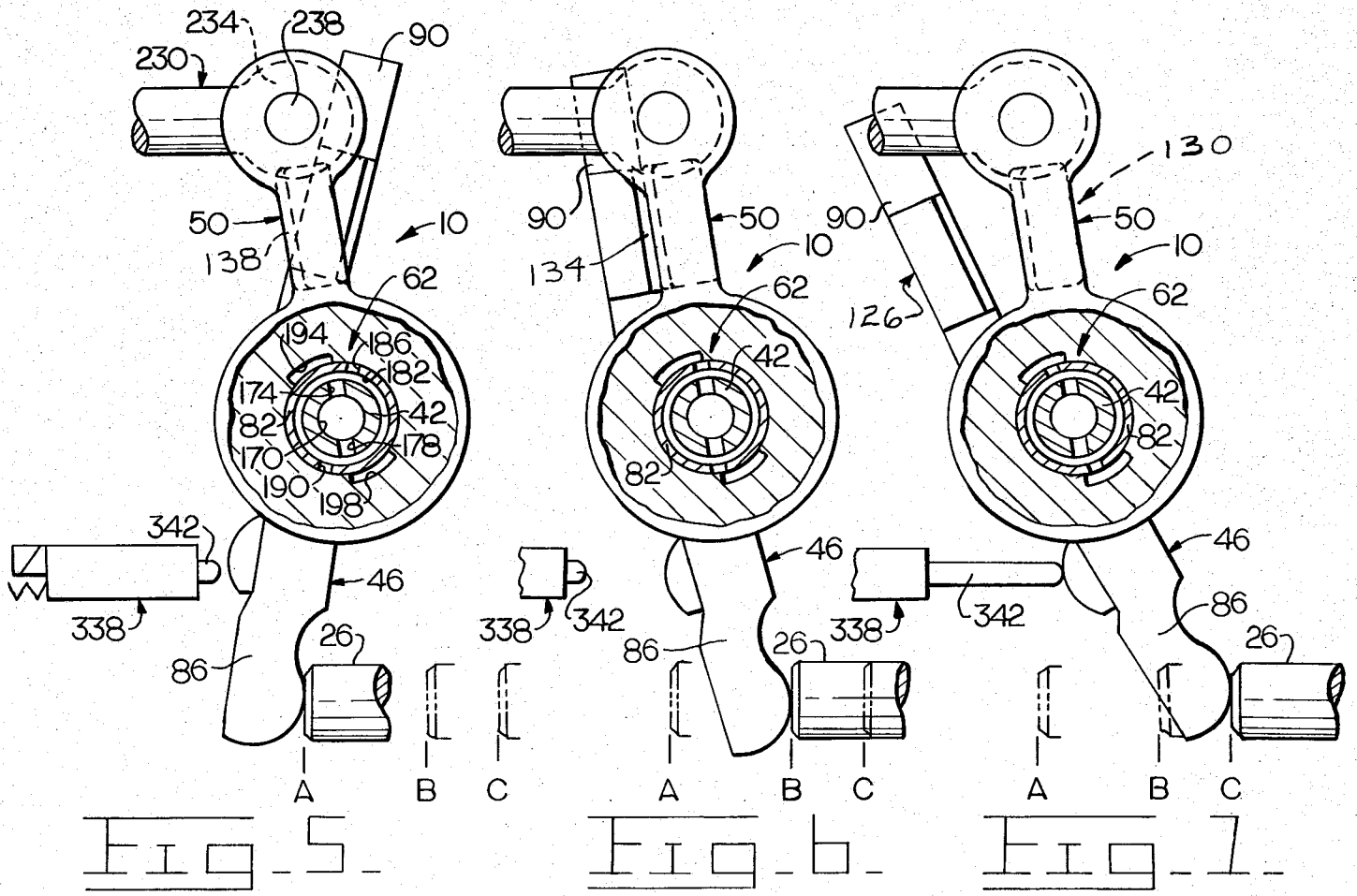
FIG. 5 is a diagrammatic and partially cross-sectional view taken along line V—V of FIG. 3 showing the fluid-powered broken-link mechanism in an engine startup position.

As shown in FIGS. 4 and 5, the valve means 62 includes an axial passage 170 and a pair of diametrically-opposed radial ports 174,178 defined in the axle 42, an internal annular groove 182 defined transversely within the hollow shaft portion 82, a pair of diametrically-opposed radial ports 186,190 defined in the shaft portion 82, and a pair of diametrically-opposed axial slots 194,198 defined in the second lever 50 and interfacing with the radial periphery of the shaft portion 82. Alternatively, the annular groove 182 may be defined around the radial periphery of the axle 42 in a plane containing the radial ports 174,178. As shown in FIGS. 5–7, the width of each generally rectangular slot 194,198 is chosen to be about two to three times wider than the diameter of each radial port 186,190 so that the radial ports 186,190 will remain registered with the respective axial slots 194,198 over a preselected range of relative angular movement between the first and second levers 46,50.

The axial passage 170 of the axle 42 is in continuous communication with the stepped bore 162 of the governor housing 34. Likewise, the radial ports 174,178 of the axle are in continuous communication with the internal annular groove 182 and radial ports 186,190 of the shaft portion 82. As shown in FIG. 4, the radial ports 186,190 of the shaft portion lie in a radial plane which always intersects the axial slots 194,198 of the axially movable second lever 50. The axial slots 194,198 intersect the counterbore 110 of the second lever 50 and therefore are in continuous communication with the annular fluid pressure chamber 158.

Various specific constructions for the governor 30 are well known, such as disclosed in U.S. Pat. No. 3,145,624 issued to Parks et al on Aug. 25, 1964, and form no part of the present invention. An exemplary governor is schematically shown in FIG. 1 which includes an operator's rotatable throttle lever 202 and a governor spring 206 in contact therewith to axially move the fuel quantity control member 26 leftwardly in the fuel-increasing direction. The governor 30 further includes a plurality of centrifugal flyweights 210, only one of which is shown, which are pivotally mounted on a carrier (not shown) that is rotated by the engine's timing gear train (not shown) at a speed proportional to engine speed. During engine operation, the flyweights 210 orbit about the rotational axis of the carrier and develop a centrifugal force which is inversely proportional to the mechanically sensed engine speed.

As shown in FIG. 1, the override means 38 or air-fuel ratio control device basically includes a hollow body 214 having a stepped central axial bore 216, a cup-shaped cap 218, a flexible annular diaphragm 222, an elongated piston 226, and a rod 230. The cup-shaped cap 218 is rigidly connected, preferably by crimping, to the generally cylindrical hollow body 214 so that all of the other components of the air-fuel ratio control device 38, except for the rod 230, are permanently encapsulated within. Such an arrangement advantageously makes the air-fuel ratio control device a relatively inexpensive, tamper-proof and replaceable cartridge of the air-fuel ratio control system 14.

The rod 230 has one enlarged end portion 234 which is pivotally connected by a pin 238 therethrough to the yoke portion 122 of the second lever 50. The other end portion 242 of the rod is externally threaded and is threadedly connected to an internally-threaded tubular insert 246 that is rigidly fixed within one end portion 250 of the piston 226 extending outwardly through a central axial hole 254 formed in the cup-shaped cap 218. A cylindrical plain bearing 258 is rigidly mounted around the other end portion 262 of the piston 226 and is loosely guided within a sleeve 266 that is rigidly connected to one enlarged end portion 268 of the bore 216 of the hollow body 214.

A middle portion 270 of the piston 226 has a radially-extending curved annular leg 274 which is connected to and supports the annular diaphragm 222 such that together the piston and diaphragm sealedly divide the hollow interior of the air-fuel ratio control device 38 into a pair of adjacent cavities 278,282. A first helical compression spring 286 is disposed in one cavity 278 between the hollow body 214 and the diaphragm 222. A second helical compression spring 290 is disposed in the other cavity 282 between the curved annular leg 274 of the piston 226 and the cup-shaped cap 218. Preferably, a washer 294 is located around the piston middle portion 270 between the first spring 286 and the diaphragm 222.

The middle portion of the stepped central axial bore 216 of the hollow body 214 is internally-threaded and adapted to receive a setscrew 298. The setscrew is axially adjustable to contact and positively stop the other end portion 262 of the piston 226 and to selectively preload the first and second springs 286,290.

As shown in FIGS. 1 and 2, the air-fuel ratio control device 38 is removably mounted as a preassembled unit or cartridge into an aperture 302 of the governor housing 34. A radially-extending annular projection 306 formed around the middle periphery of the cup-shaped cap 218 has oppositely-facing, transversely-oriented, annular surfaces 310,314 which are sandwiched between and supported by a crescent-shaped outer plate 318 and an inner or back plate 322 which abuts the outside of the governor housing 34. A pair of bolts 326 clamp the outer and inner plates 318,322 to the respective surfaces 310,314 of the annular projection 306 of the air-fuel ratio control device 38 as well as to the governor housing 34. Alternatively, for ease of sequential rather than simultaneous assembly, a first pair of bolts may clamp only the inner plate 322 to the housing 34 while a second pair of bolts, angularly offset from the first pair of bolts, may clamp the outer plate 318 and annular projection 306 of the device 38 to just the inner plate 322.

Another enlarged end portion 330 of the bore 216 of the body 214 is connected to an air line 334 which is tapped into the air intake manifold 18 of the engine. During engine operation, the air line 334 communicates a relatively small amount of pressurized air from the air intake manifold 18 to the one cavity 278 of the air-fuel ratio control device 38 via one or more axially-oriented grooves extending across the threaded middle portion of the bore 216.

Preferably, a conventional fuel shutoff solenoid 338 shown in FIGS. 1 and 5–7 is mounted in the governor housing 34 and is adapted to be electrically energized only when the electrical system of the engine is turned on. The solenoid 338 has a reciprocable plunger 342 facing the one arm 86 of the first lever 46 and is normally retracted by an internal spring when the solenoid is not electrically energized. The governor housing may also be provided with a conventional manually-operated fuel shutoff lever (not shown) which is adapted to swing into contact with the other arm 90 of the first lever 46 to rotate the first lever counterclockwise according to FIGS. 1 and 5–7.

Figures 8, 9, 10:
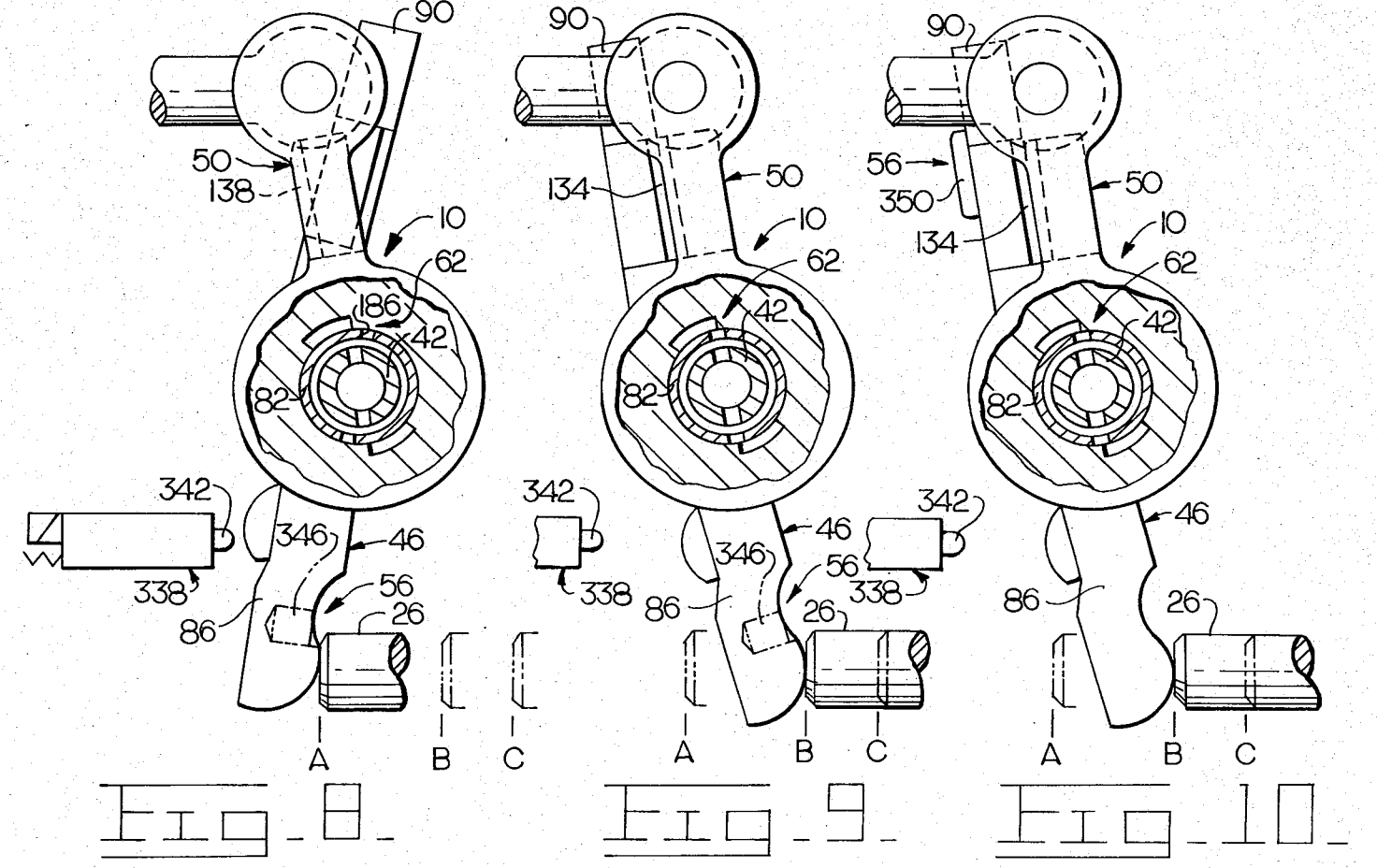
FIGS. 8 and 9 are views similar to FIGS. 5 and 6, respectively, but showing a second embodiment of a fluid-powered broken-link mechanism.
FIG. 10 is a view similar to FIG. 6 but showing a third embodiment of a fluid-powered broken-link mechanism.

FIGS. 8–9 and FIG. 10 show second and third embodiments, respectively, of the fluid-powered broken link mechanism 10. These other embodiments are similar to the first embodiment of FIGS. 1–7 except for the following differences which pertain to the axial biasing means 52 and the angular motive means 56.

In both the second and third embodiments, the axial biasing means 52 includes a helical compression spring 140 similar to the one shown in FIG. 3 except that there is no torsion spring integrally combined with it. In other words, the opposite end portions 142,146 of the helical compression spring 140 are not bent axially to angularly contact or torsionally bias the other arm 90 of the first lever 46 relative to the second lever 50.

The second and third embodiments basically differ from each other in the type of angular motive means 56 that is used. In the second embodiment of FIGS. 8–9, the angular motive means 56 includes a permanent magnet 346 which is chosen to be of a predetermined size and magnetic strength and which is imbedded or otherwise connected to the first lever arm 86 near where that arm swings into direct contact with the fuel quantity control member 26. Alternatively, the magnet 346 may be connected to the fuel quantity control member 26 near where it directly contacts the first lever arm. One reason the magnet is not placed directly at the point or area of contact between the first lever arm 86 and the fuel quantity control member 26 is to help keep that contact region free of any metallic debris which might be attacted to and held by the magnet.

In the third embodiment of FIG. 10, the angular motive means 56 includes a counterweight 350 integrally formed on or otherwise connected to the other arm 90 of the first lever 46. The counterweight 350 is positioned on the first lever other arm 90 so that, in the absence of any other external forces, the first lever 46 is biased by the force of gravity to rotate to the predetermined angular position shown in FIG. 10. Alternatively, instead of forming a discernable counterweight 350 on the arm 90, the relative masses of the arms 86,90 of the first lever 46 may be suitably chosen and distributed about the pivotal axis so that the first lever 46 naturally assumes the self-balanced position of FIG. 10.

INDUSTRIAL APPLICABILITY

While the operation of the present invention is believed clearly apparent from the foregoing description, further amplification will be made in the following brief summary of such operation.

Referring to the first embodiment of FIGS. 1–7, after the operating engine has been stopped, any pressurized engine lubricating oil in the annular fluid pressure chamber 158 of the fluid-powered broken-link mechanism 10 bleeds outwardly past the two concentric diametral clearances between the cylindrical internal wall 114 of the second lever 50, the annular stop 58, and the shaft portion 82 of the first lever 46. This bled oil, now within the general confines of the governor housing 34, communicates with the relatively low pressure engine lubricating oil sump (not shown).

As the fluid pressure in the annular fluid pressure chamber 158 bleeds down quickly without replenishment from the stopped engine oil pump (not shown), the compressed axial biasing means 52 shown in FIG. 4 axially moves the second lever 50 leftwardly along the shaft portion 82 to the disengaged axial position shown in FIG. 3 where the internal annular shoulder 118 of the second lever 50 abuts the annular stop 58. As shown in FIG. 3, the tang portion 130 of the second lever 50 is now completely free of drivable engagement with the tang portion 126 of the first lever 46 so that the first lever 46, fuel quantity control member 26, and governor 30 are effectively and automatically disengaged from the air-fuel ratio control device 38 after the engine has been stopped.

In order to start the engine with excess or maximum fuel delivery, the fuel shutoff solenoid 338 is electrically energized to retract the plunger 342 away from the first lever 46 to the position shown in FIG. 5. Then the operator's throttle lever 202 shown in FIG. 1 is manually rotated clockwise to axially move the governor spring 206 and fuel quantity control member 26 leftwardly in the fuel-increasing direction until the fuel quantity control member 26 assumes a first predetermined position "A" shown in FIG. 5 prior to engine startup. The first predetermined position "A" of the fuel quantity control member 26 is chosen to be an excess or maximum fuel supply position for dependable starting. As the fuel quantity control member 26 is axially moved in the fuel-increasing direction, it contacts the one arm 86 of the first lever 46 and rotates the first lever clockwise, in opposition to a torsional force of the angular motive means 56, to a first predetermined angular position shown in FIG. 5. At the first predetermined angular position of the first lever 46, the radial ports 186,190 of the shaft portion 82 are not registered with the axial slots 194,198 of the second lever 50.

Thus, during initial auxiliary cranking of the engine, pressurized engine oil immediately delivered via passage 166 and stepped bore 162 of the governor housing 34, axial passage 170 and radial ports 174,178 of the axle 42, and internal annular groove 182 and radial ports 186,190 of the shaft portion 82 is blocked by the valve means 62 from communicating with the axial slots 194,198 and the annular fluid pressure chamber 158. In the absence of fluid pressure in the annular fluid pressure chamber 158, the axial biasing means 52 maintains the second lever 50 axially disengaged from the first lever 46 so that the air-fuel ratio control device 38 will not interfere with the fuel quantity control member 26 moving to the position "A" and staying there to provide excess or maximum fuel delivery during engine starting.

As the engine starts under its own power and initially gains rotational speed, the orbiting centrifugal flyweights 210 of the governor 30 pivot counterclockwise as shown in FIG. 1 to axially move the fuel quantity control member 26 rightwardly in the fuel-decreasing direction until the centrifugal force of the flyweights 210 becomes balanced against the opposing force of the governor spring 206. As the fuel quantity control member 26 is axially moved in the fuel-decreasing direction from its excess or maximum fuel delivery position "A" shown in FIG. 5 to a normal engine operating position "B" shown in FIG. 6, the first lever 46 is rotated counterclockwise by the torsional force of the angular motive means 56 to a second predetermined angular position at which the tang portion 126 of the first lever becomes substantially aligned with the tang portion 130 of the second lever 50 to facilitate drivable engagement although the tang portions 126,130 are still axially spaced apart.

Approximately when or just before the fuel quantity control member 26 reaches the normal engine operating position "B", it passes through a preselected axial position referred to as the air-fuel ratio control setting at which the radial ports 186,190 of the shaft portion 82 initially become registered, and remain registered during the remainder of engine operation, with the relatively wider axial slots 194,198 of the second lever 50. Thus, the air-fuel ratio control setting determines when the air-fuel ratio control device 38 is initially activated.

Once the radial ports 186,190 are registered with the axial slots 194,198, the valve means 62 thereby opens fluid communication of pressurized engine lubrication oil from the shaft portion 82 to the axial slots 194,198 leading to the annular fluid pressure chamber 158. Although some fluid bleeds from the annular fluid pressure chamber 158 through the aforementioned diametral clearances of the annular stop 58, the diametral clearances are chosen to be sufficiently small and the flowrate of fluid supplied by the engine-driven oil pump is chosen to be of a sufficient magnitude such that enough fluid pressure is maintained in the annular fluid pressure chamber 158 during engine operation to quickly move the second lever 50 under hydraulic or other pressurized fluid power. Consequently, the second lever 50 is hydraulically moved in opposition to a chosen compressive force of the compressed axial biasing means 52 to the engaged axial position shown in FIG. 4 where the cylindrical portion 106 of the second lever 50 abuts the first lever 46. As the second lever 50 axially approaches the first lever 46, the beveled lateral end surfaces 134,138 can temporarily contact and slide past one another to ensure that the tang portion 130 of the second lever 50 smoothly ramps upon the tang portion 126 of the first lever 46 for achieving drivable engagement in overlapping relation.

Once the tang portions 126,130 of the first and second levers 46,50 are axially engaged or positively latched in one angular direction and are maintained that way by the fluid pressure in annular fluid pressure chamber 158, the air-fuel ratio control device 38 shown in FIG. 1 is thereby effectively and automatically activated or engaged to selectively limit travel of the fuel quantity control member 26 in the fuel-increasing direction when the ratio of air-to-fuel supplied to the engine for combustion falls below a preselected value. Since, the air-fuel ratio control device 38 is activated after engine startup solely in combined response to the immediate existence of engine oil pressure and the governor 30 initially moving the fuel quantity control member 26 from its excess or maximum fuel delivery position "A" to a preselected air-fuel ratio control setting "B", the duration and quantity of smoke produced during engine startup is advantageously minimized.

In FIG. 1, the diaphragm 222 and the piston 226 of the air-fuel ratio control device 38 are shown in an equilibrium position balanced only by the opposing springs 286,290. In other words, FIG. 1 as well as FIGS. 5–7 show substantially no boost air pressure being supplied by the supercharger 22 to the air intake manifold 18 as well as to the one cavity 278 of the air-fuel ratio control device 38.

When air pressure increases in the one cavity 278 during engine operation, the diaphragm 222, piston 226, and rod 230 move rightwardly to rotate the second lever 50 clockwise in FIG. 1. As the second lever 50 is rotated clockwise, frictional contact between the cylindrical portion 106 and the first lever 46 causes the first lever to simultaneously rotate clockwise an equal amount so that the one arm 86 of the first lever is axially spaced further from the fuel quantity control member 26. Thus with increasing boost air pressure, the governor 30 is permitted to move the fuel quantity control member 26 proportionally further in the fuel-increasing direction. Similarly, as air pressure decreases in the one cavity 278 of the air-fuel ratio control device, the second lever 50 and first lever 46 are simultaneously rotated counterclockwise in FIG. 1 to proportionally restrict movement of the fuel quantity control member 26 in the fuel-increasing direction by overriding the force of the governor spring 206.

The setting of the fuel quantity control member 26 at which the air-fuel ratio control device 38 is effectively activated after engine startup may be easily adjusted as follows. First, the air line 334 shown in FIG. 1 is disconnected from the body 214 and the bolts 326 are loosened slightly from the governor housing 34. Then the air-fuel ratio control device 38 is simply manually rotated as an entire unit within the supporting and loosely clamped plates 318,322 either clockwise or counterclockwise as viewed in FIG. 2 to threadedly draw the rod 230 in or out of the tubular insert 246 causing counterclockwise or clockwise rotation of the first lever 46 as viewed in FIGS. 1 or 5–7. Once the one arm 86 of the first lever 46 contacts the fuel quantity control member 26 at the desired axial position of the fuel quantity control member, the bolts 326 are retightened to the governor housing 34 and the air line 334 is reconnected to the body 214. The air-fuel ratio control setting is chosen so that the started engine will have gained sufficient rotational speed, as mechanically sensed by the governor 30, to prevent stalling when the air-fuel ratio control 38 is initially activated.

When it is desired to shut off the engine, the fuel shutoff solenoid 338 is electrically deenergized so that the previously retracted plunger 342 moves outwardly to contact and rotate the first lever 46 counterclockwise, relative to the second lever 50, to a third predetermined angular position shown in FIG. 7. As the first lever 46 is rotated to the third predetermined angular position, the one arm 86 of the first lever axially moves the fuel quantity control member 26 rightwardly in the fuel-decreasing direction to a fuel shutoff position "C" shown in FIG. 7. Alternatively, the first lever 46 may be rotated to the third angular position by the manually-operated fuel shutoff lever (not shown).

In any event, once the engine is shut off, the fluid pressure in the annular fluid pressure chamber 158 then bleeds without replenishment through the diametral clearances of the annular stop 58 so that the compressed axial biasing means 52 can automatically axially disengage the second lever 50 from the first lever 46 as previously described. The diametral clearances of the annular stop 58 are also chosen to be of a sufficiently large magnitude such that the fluid pressure in the annular fluid pressure chamber 158 may bleed rapidly enough for axially disengaging the second lever 50 to permit quick restarting of the engine.

The second embodiment of FIGS. 8–9 basically differs in operation from the first embodiment of FIGS. 1–7 in that the permanent magnet 346 performs the functions of the angular motive means 56 instead of a torsional spring. Referring to FIG. 8, as the fuel quantity control member 26 is axially moved to the excess fuel delivery position "A" for engine starting, the member 26 directly contacts and rotates the first lever 46 counterclockwise to the first predetermined angular position. At the first predetermined angular position, the first lever 46 is magnetically coupled for combined movement with the magnetically attracted fuel quantity control member 26 due to the sufficiently close proximity of the permanent magnet 346 relative to the member 26.

As the engine starts under its own power and the governor 30 axially moves the fuel quantity control member 26 to a normal engine operating position "B" shown in FIG. 9, the magnetic force causes the first lever 46 to follow the fuel quantity control member 26. Thus, the first lever 46 is rotated to the second predetermined angular position at which the first and second levers 46,50 are substantially angularly aligned to facilitate drivable engagement and also the angular position at which fluid communication is established between the source 166 of fluid and the fluid power means 156 to axially move the second lever 50 under pressurized fluid power to the engaged axial position similar to that shown in FIG. 4.

The size, strength, and position of the permanent magnet 346 are chosen such that as the first lever 46 approaches the second predetermined angular position, the magnetic force effectively acting on the fuel quantity control member 26 gradually decreases until the member 26 is either completely or substantially magnetically uncoupled with the first lever 46. FIGS. 8–9 illustrate that as the first lever 46 is rotated from the first predetermined angular position to the second predetermined angular position, the contact point or area directly between the fuel quantity control member 26 and a curved portion of the one arm 86 gradually shifts further away from the magnet 346 until the magnetic uncoupling occurs. By this arrangement, the gradual decrease in magnetic attraction between the first lever 46 and the fuel quantity control member 26 ensures that the magnetic uncoupling occurs smoothly and thereby helps prevent the occurrence of jerking or sudden vibration in the member 26, as it separates from the one arm 86, which could temporarily upset normal governor operation.

The operation of the third embodiment of FIG. 10 basically differs from the second embodiment of FIGS. 8–9 in that the counterweight 350, instead of a permanent magnet, helps perform the functions of the angular motive means 56. The counterweight 350 is positioned on the first lever other arm 90 so that as the fuel quantity control member 26 is axially moved from the excess fuel position "A" to a normal engine operating position "B", the arms 86,90 of the first lever 46 become unbalanced with the force of gravity. This unbalanced state naturally causes the first lever to rotate from the first predetermined angular position to a self-balanced state in the second predetermined angular position shown in FIG. 10. Of course, normal engine vibration will also help the first lever 46 to rotate to its balanced state.

Other aspects, objects, and advantages of this invention can be obtained from a study of the drawings, the disclosure and the appended claims.

I claim:

1. A fluid-powered broken-link mechanism for an internal combustion engine, said engine having a housing, a source of fluid which is adapted to be pressurized only during engine operation, a fuel quantity control member movable in both a fuel-increasing direction to increase the quantity of fuel supplied to the engine during each combustion cycle and in a fuel-decreasing direction to decrease the quantity of fuel supplied to the engine during each combustion cycle, a governor controlling the position of the fuel quantity control member, and an override means for selectively overriding the governor during engine operation to prevent movement of the fuel quantity control member in the fuel-increasing direction when the ratio of air-to-fuel supplied to the engine for combustion falls below a preselected value, said fluid-powered broken-link mechanism adapted to be operatively linked between the override means and the fuel quantity control member and comprising:

a first lever having a shaft portion adapted to be rotatively mounted within the housing and an arm adapted to swing into contact with the fuel quantity control member;

a second lever adapted to be pivotally connected to said override means and being rotatively mounted on the shaft portion and also being axially movable thereon between a disengaged axial position at which the second lever is completely free of drivable engagement with the first lever and an engaged axial position at which the second lever drivably engages the first lever in one angular direction;

axial biasing means for axially biasing the second lever towards the disengaged axial position;

angular motive means for rotating the first lever relative to the second lever so that the axially engageable portions of the levers are substantially angularly aligned to facilitate drivable engagement;

fluid power means for moving the second lever to the engaged axial position against the bias of the axial biasing means when pressurized fluid is communicated thereto; and valve means for selectively blocking fluid communication between the source of fluid and the fluid power means when the first lever is rotated to a first predetermined angular position and for selectively opening fluid communication between the source of fluid and the fluid power means to axially move the second lever under pressurized fluid power to the engaged axial position when the first lever is rotated to a second predetermined angular position.

2. The fluid-powered broken-link mechanism, as set forth in claim 1, wherein said valve means is jointly defined by the shaft portion and the second lever.

3. The fluid-powered broken-link mechanism, as set forth in claim 2, wherein said valve means includes a radial port defined in the shaft portion and an axial slot defined in the second lever and interfacing with the shaft portion, said radial port of the shaft portion adapted to be in continuous communication with the source of fluid and also lying in a radial plane which always intersects the axial slot of the second lever, said axial slot of the second lever being in continuous communication with the fluid power means, said radial port of the shaft portion not registering with the axial slot of the second lever when the first lever is at the first predetermined angular position, said radial port of the shaft portion registering with the axial slot of the second lever when the first lever is at the second predetermined angular position.

4. The fluid-powered broken-link mechanism, as set forth in claim 1, wherein said fluid-power means includes a fluid pressure chamber jointly defined by the second lever and the shaft portion.

5. The fluid-powered broken-link mechanism, as set forth in claim 4, wherein said fluid pressure chamber expands in volume as the second lever moves axially toward the engaged axial position and which contracts in volume as the second lever moves axially toward the disengaged axial position.

6. The fluid-powered broken-link mechanism, as set forth in claim 5, wherein said fluid pressure chamber is further defined by an axial counterbore wall of the second lever and an annular stop mounted radially between the shaft portion and the second lever, said annular stop having a radial peripheral surface on which the axial counterbore wall is guided as the second lever moves toward the disengaged axial position.

7. The fluid-powered broken-link mechanism, as set forth in claim 1, wherein said first lever is adapted to be rotated to the first predetermined angular position by the fuel quantity control member moving in the fuel-increasing direction to a first predetermined position prior to engine startup and wherein the first lever is adapted to be rotated by the angular motive means to the second predetermined angular position as the governor initially moves the fuel quantity control member in the fuel-decreasing direction to a second predetermined position after engine startup.

8. The fluid-powered broken-link mechanism, as set forth in claim 1, wherein said axial biasing means and said angular motive means are a combination helical compression and torsion spring positioned around the shaft portion and located axially between the second lever and the first lever.

9. The fluid-powered broken-link mechanism, as set forth in claim 1, wherein said axial biasing means is a helical compression spring positioned around the shaft portion and located axially between the second lever and the first lever.

10. The fluid-powered broken-link mechanism, as set forth in claim 1, wherein said angular motive means includes a permanent magnet connected to one of said first lever arm or said fuel quantity control member and adapted to magnetically attract the other of said first lever arm or said fuel quantity control member.

11. The fluid-powered broken-link mechanism, as set forth in claim 10, wherein said permanent magnet is connected to the first lever arm and is positioned so that the magnet is adapted to be magnetically coupled with the fuel quantity control member for combined movement when the first lever is rotated to the first predetermined angular position and so that the magnetic force effectively acting on the fuel quantity control member is gradually reduced when the first lever is thereafter rotated to the second predetermined angular position.

12. The fluid-powered broken-link mechanism, as set forth in claim 1, wherein said angular motive means includes a counterweight connected to the first lever and positioned such that the counterweight biases the first lever for rotation from the first predetermined angular position to the second predetermined angular position.

13. The fluid-powered broken-link mechanism, as set forth in claim 1, wherein said first and second levers each have tang portions which laterally face each other and which are complementarily shaped to ramp upon one another in overlapping relation as the second lever axially engages the first lever.

14. A fluid-powered broken-link mechanism for an internal combustion engine, said engine having a housing, a source of fluid which is adapted to be pressurized only during engine operation, a fuel quantity control member movable in both a fuel-increasing direction to increase the quantity of fuel supplied to the engine during each combustion cycle and in a fuel-decreasing direction to decrease the quantity of fuel supplied to the engine during each combustion cycle, a governor controlling the position of the fuel quantity control member, and an override means for selectively overriding the governor during engine operation to prevent movement of the fuel quantity control member in the fuel-increasing direction when the ratio of air-to-fuel supplied to the engine for combustion falls below a preselected value, said fluid-powered broken-link mechanism adapted to be operatively linked between the override means and the fuel quantity control member and comprising:

a first lever having a shaft portion adapted to be rotatively mounted within the housing and a pair of relatively fixed arms radially extending from the shaft portion wherein one of the arms is adapted to swing into contact with the fuel quantity control member;

a second lever adapted to be pivotally connected to said override means and being rotatively mounted on the shaft portion and also being axially movable thereon between a disengaged axial position at which the second lever is completely free of drivable engagement with the first lever and an engaged axial position at which the second lever drivably engages the other arm of the first lever in one angular direction, said second lever and the shaft portion jointly defining an expandable and contractable fluid pressure chamber which expands in volume as the second lever moves axially toward the engaged axial position and which contracts in volume as the second lever moves axially toward the disengaged axial position;

resilient biasing means for both axially resiliently biasing the second lever towards the disengaged axial position and for angularly resiliently biasing the other arm of the first lever relative to the second lever so that the axially engageable portions of the levers are substantially angularly aligned with one another to facilitate drivable engagement; and valve means defined in said shaft portion and the second lever for selectively blocking and opening fluid communication between the fluid pressure chamber and the source of fluid, said valve means blocking fluid communication to the fluid pressure chamber when the first lever is rotated in opposition to the resilient biasing means to a first predetermined angular position by the fuel quantity control member moving in the fuel-increasing direction to a first predetermined position prior to engine startup, said valve means opening fluid communication to the fluid pressure chamber to axially move the second lever under pressurized fluid power to the engaged axial position when the first lever is rotated by the resilient biasing means to a second predetermined angular position as the governor initially moves the fuel quantity control member in the fuel-decreasing direction to a second predetermined position after engine startup.

15. The fluid-powered broken-link mechanism, as set forth in claim 14, wherein said valve means includes a radial port defined in the shaft portion and an axial slot defined in the second lever and interfacing with the shaft portion, said radial port of the shaft portion adapted to be in continuous communication with the source of fluid and also lying in a radial plane which always intersects the axial slot of the second lever, said axial slot of the second lever being in continuous communication with the fluid pressure chamber, said radial port of the shaft portion not registering with the axial slot of the second lever when the first lever is at the first predetermined angular position, said radial port of the shaft portion registering with the axial slot of the second lever when the first lever is at the second predetermined angular position.

16. An air-fuel ratio control system for an internal combustion engine having a housing and a source of fluid which is adapted to be pressurized only during engine operation, said air-fuel ratio control system comprising:

a fuel quantity control member movable in both a fuel-increasing direction to increase the quantity of fuel supplied to the engine during each combustion cycle and in a fuel-decreasing direction to decrease the quantity of fuel supplied to the engine during each combustion cycle;

a governor controlling the position of the fuel quantity control member in response to sensed engine speed;

an override means for selectively overriding the governor during engine operation to prevent movement of the fuel quantity control member in the fuel-increasing direction when the ratio of air-to-fuel supplied to the engine for combustion falls below a preselected value;

a fluid-powered broken-link mechanism operatively linked between the override means and the fuel quantity control member, said mechanism including a first lever having a shaft portion adapted to be rotatively mounted within the housing and an arm adapted to swing into contact with the fuel quantity control member, a second lever pivotally connected to the override means and being rotatively mounted on the shaft portion and also being axially movable thereon between a disengaged axial position at which the second lever is completely free of drivable engagement with the first lever and an engaged axial position at which the second lever drivably engages the first lever in one angular direction, axial biasing means for axially biasing the second lever towards the disengaged axial position, angular motive means for rotating the first lever relative to the second lever so that the axially engageable portions of the levers are substantially angularly aligned to facilitate drivable engagement, fluid power means for moving the second lever to the engaged axial position against the bias of the axial biasing means when pressurized fluid is communicated thereto, and valve means for selectively blocking fluid communication between the source of fluid and the fluid power means when the first lever is rotated to a first predetermined angular position and for selectively opening fluid communication between the source of fluid and the fluid power means to axially move the second lever under pressurized fluid power to the engaged axial position when the first lever is rotated to a second predetermined angular position.

17. The air-fuel ratio control system, as set forth in claim 16, wherein said valve means is jointly defined by the shaft portion and the second lever.

18. The air-fuel ratio control system, as set forth in claim 17, wherein said valve means includes a radial port defined in the shaft portion and an axial slot defined in the second lever and interfacing with the shaft portion, said radial port of the shaft portion adapted to be in continuous communication with the source of fluid and also lying in a radial plane which always intersects the axial slot of the second lever, said axial slot of the second lever being in continuous communication with the fluid power means, said radial port of the shaft portion not registering with the axial slot of the second lever when the first lever is at the first predetermined angular position, said radial port of the shaft portion registering with the axial slot of the second lever when the first lever is at the second predetermined angular position.

19. The air-fuel ratio control system, as set forth in claim 16, wherein said fluid power means includes a fluid pressure chamber jointly defined by the second lever and the shaft portion.

20. The air-fuel ratio control system, as set forth in claim 19, wherein said fluid pressure chamber expands in volume as the second lever moves axially toward the engaged axial position and which contracts in volume as the second lever moves axially toward the disengaged axial position.

21. The air-fuel ratio control system, as set forth in claim 20, wherein said fluid pressure chamber is further defined by an axial counterbore wall of the second lever and an annular stop mounted radially between the shaft portion and the second lever, said annular stop having a radial peripheral surface on which the axial counterbore wall is guided as the second lever moves toward the disengaged axial position.

22. The air-fuel ratio control system, as set forth in claim 16, wherein said first lever is rotated to the first predetermined angular position by the fuel quantity control member moving in the fuel-increasing direction to a first predetermined position prior to engine startup and wherein the first lever is rotated by the angular motive means to the second predetermined angular position as the governor initially moves the fuel quantity control member in the fuel-decreasing direction to a second predetermined position after engine startup.

23. The air-fuel ratio control system, as set forth in claim 16, wherein said axial biasing means and said angular motive means are a combination helical compression and torsion spring positioned around the shaft portion and located axially between the second lever and the first lever.

24. The air-fuel ratio control system, as set forth in claim 16, wherein said axial biasing means is a helical compression spring positioned around the shaft portion and located axially between the second lever and the first lever.

25. The air-fuel ratio control system, as set forth in claim 16, wherein said angular motive means includes a permanent magnet connected to one of said first lever arm or said fuel quantity control member and adapted to magnetically attract the other of said first lever arm or said fuel quantity control member.

26. The air-fuel ratio control system, as set forth in claim 25, wherein said permanent magnet is connected to the first lever arm and is positioned so that the permanent magnet is adapted to be magnetically coupled with the fuel quantity control member for combined movement when the first lever is rotated to the first predetermined angular position and so that the magnetic force effectively acting on the fuel quantity control member is gradually reduced when the first lever is thereafter rotated to the second predetermined angular position.

27. The air-fuel ratio control system, as set forth in claim 16, wherein said angular motive means includes a counterweight connected to the first lever and positioned such that the counterweight biases the first lever for rotation from the first predetermined angular position to the second predetermined angular position.

28. The air-fuel ratio control system, as set forth in claim 16, wherein said first and second levers each have tang portions which laterally face each other and which are complementarily shaped to ramp upon one another in overlapping relation as the second lever axially engages the first lever.

* * * * *